US006076338A

United States Patent [19]

Maeda et al.

[11] Patent Number: 6,076,338

[45] Date of Patent: Jun. 20, 2000

[54] BAND GUIDING STRUCTURE FOR A PACKING MACHINE

[75] Inventors: Kouya Maeda; Norio Okazawa, both of Chiba, Japan

[73] Assignee: Naigai Ltd., Sanbu-gun, Japan

[21] Appl. No.: 09/182,795

[22] Filed: Oct. 30, 1998

[30] Foreign Application Priority Data

Mar. 10, 1998 [JP] Japan ..... 10-075011

[51] Int. Cl.[7] ..... B65B 13/04

[52] U.S. Cl. ..... 53/589; 100/26

[58] Field of Search ..... 53/589; 100/25, 100/26, 32

[56] References Cited

U.S. PATENT DOCUMENTS

| | | | |
|---|---|---|---|
| 3,536,430 | 10/1970 | Kurihara | 100/26 |
| 4,885,901 | 12/1989 | Sakaki et al. | 53/589 |
| 5,333,438 | 8/1994 | Gurak et al. | 53/589 X |
| 5,442,899 | 8/1995 | Shibazaki et al. | 53/589 |
| 5,459,977 | 10/1995 | Haberstroh | 53/589 X |

FOREIGN PATENT DOCUMENTS

| | | |
|---|---|---|
| 0 596 288 | 5/1994 | European Pat. Off. . |
| 3 744 33 | 1/1989 | Germany . |
| 9 412 338 | 11/1994 | Germany . |

*Primary Examiner*—Linda Johnson
*Attorney, Agent, or Firm*—Oblon, Spivak, McClelland, Maier & Neustadt, P.C.

[57] ABSTRACT

A pool box for storing a band which is either fed or reversed is arranged between a pre-feed roller and a band forward-reverse unit. A band guide path is formed by two parallel plates. The band guide path connects the pre-feed roller to the band forward-reverse unit via a pool box. An opening is provided in one of the parallel plates in the pool box. A structure for guiding an end of band so as not to jump out of the opening is also provided. Then, the band is guided through the bland guide path from the pre-feed roller to the band forward-reverse unit without the end of the band jumping out from the opening. After setting the band to the packing machine, the band which is either fed or reversed will jump out of the opening, so that the band is stored in the pool box.

13 Claims, 10 Drawing Sheets

BAND GUIDING STRUCTURE FOR A PACKING MACHINE

BACKGROUND OF THE INVENTION

1. Field of the Invention:

The present invention relates to a band guiding structure for a packing machine for feeding a band from a pre-feed roller to a band forward-reverse unit and for guiding a band which is either fed or reversed in a pool box.

2. Description of the Background

Conventional packing machines, which guide a band from a pre-feed roller around a band guide arch and which package goods positioned in the band guide arch by wrapping with the band, are popularly used. Such packing machines include a pool box for temporarily storing the band between the pre-feed roller and the band guide arch.

The pre-feed roller continuously pulls the band in a band guide path during a banding operation. Thus, the band is fed forward in the banding operation. The band also reverses in order to band the goods tightly in the banding operation. Consequently, if the band cannot go forward or is reversed while being continuously fed, the band must have a way to escape from the band guide path. The pool box provides an escape for the band. That is, the band guiding structure guides the band to the band guide arch without storing the band in the pool box when the band is fed for the first time. The band guiding structure, however, will guide the band into the pool box when the band is either fed forward or reversed.

A large capacity of pool box is preferred in view of the function of the pool box. A large amount of band will indeed be stored in the pool box during the banding operation.

As shown in FIG. 1, one example of background packing machine provides a guide plate 104 for introducing and guiding the band B. The guide plate 104 is rotatably attached to a pool box 101 and is arranged between a pair of pre-feed rollers 102 and a band forward-reverse unit 103. In the example, the guide plate 104 is operated by hand or by electric power.

That is, the guide plate 104 is normally positioned as shown by a solid line in FIG. 1. This is the position when the band B is fed for the first time. Once the band B is used by the packing machine, the guide plate 104 will rotate as shown by the dotted line in FIG. 1. Thus, an entrance 105 of the pool box is opened and the guide plate 104 expands into the capacity of the pool box 101 for storing the band B.

Disadvantages of the background packing machine are now described hereinafter. A device having a guide plate 104 operated by hand has a disadvantage that the guide plate 104 must be operated whenever the band B is replaced or re-inserted into the pre-feed rollers 102, so that the operation of the guide plate 104 is troublesome and complicated. If the guide plate 104 is not completely set, the band B may not be correctly introduced into the packing machine, so that some trouble may occur. A device having a guide plate 104 operated by electric power has the possibility that the guide plate 104 is not completely set. As mentioned above, if the guide plate 104 is not completely set, the band B may not be correctly introduced into the packing machine, so that some trouble may occur. The structure having the guide plate 104 operated by electric power also has a disadvantage that the structure is complicated and expensive.

SUMMARY OF THE INVENTION

Accordingly, an object of the present invention is to provide a band guiding structure which is capable of guiding a band to a pool box without moving the band guide path.

Another object of the present invention is to provide a band guide structure which is capable of guiding a band to a pool box without power source.

These and further objects of the present invention are achieved by the novel band guiding structure for a packing machine of the present invention. According to the present invention, a band guide path formed by two parallel plates is placed in a pool box for storing a band which is either fed or reversed and is arranged between a pre-feed roller and a band forward-reverse unit. The band guide path connects the pre-feed roller to the band forward-reverse unit via the pool box. An opening is provided in one of the parallel plates in the pool box. A device for guiding the end of the band so it will not jump out from the opening is also provided. Then, the band is guided through the band guide path from the pre-feed roller to the band forward-reverse unit without the end of the band jumping out of the opening. After using the band in the packing machine, the band which is either fed or reversed will jump out of the opening, so that the band is stored in the pool box. Accordingly, the band can be automatically guided to the pool box without moving the band guide path and without a power source.

BRIEF DESCRIPTION OF THE DRAWINGS

A more complete appreciation of the present invention and many of the attendant advantages thereof will be readily obtained as the same better understood by reference to the following detailed description when considered in connection with the accompanying drawings, in which.

DETAILED DESCRIPTION OF THE PREFERRED EMBODIMENTS

A first embodiment of the present invention is now explained with reference to FIGS. 2 to 4.

Figure 1:
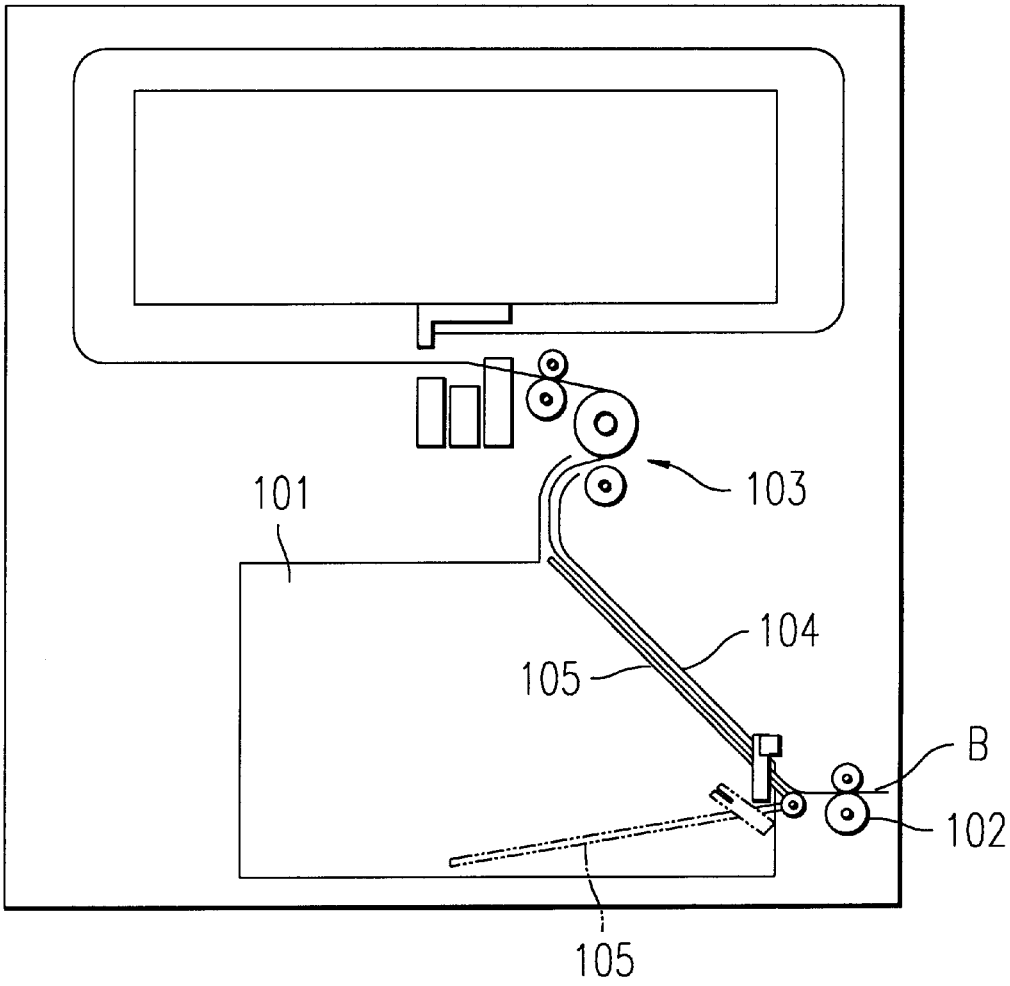
FIG. 1 PRIOR ART
FIG. 1 is a sectional elevation showing a prior art packing machine.
Figure 2:
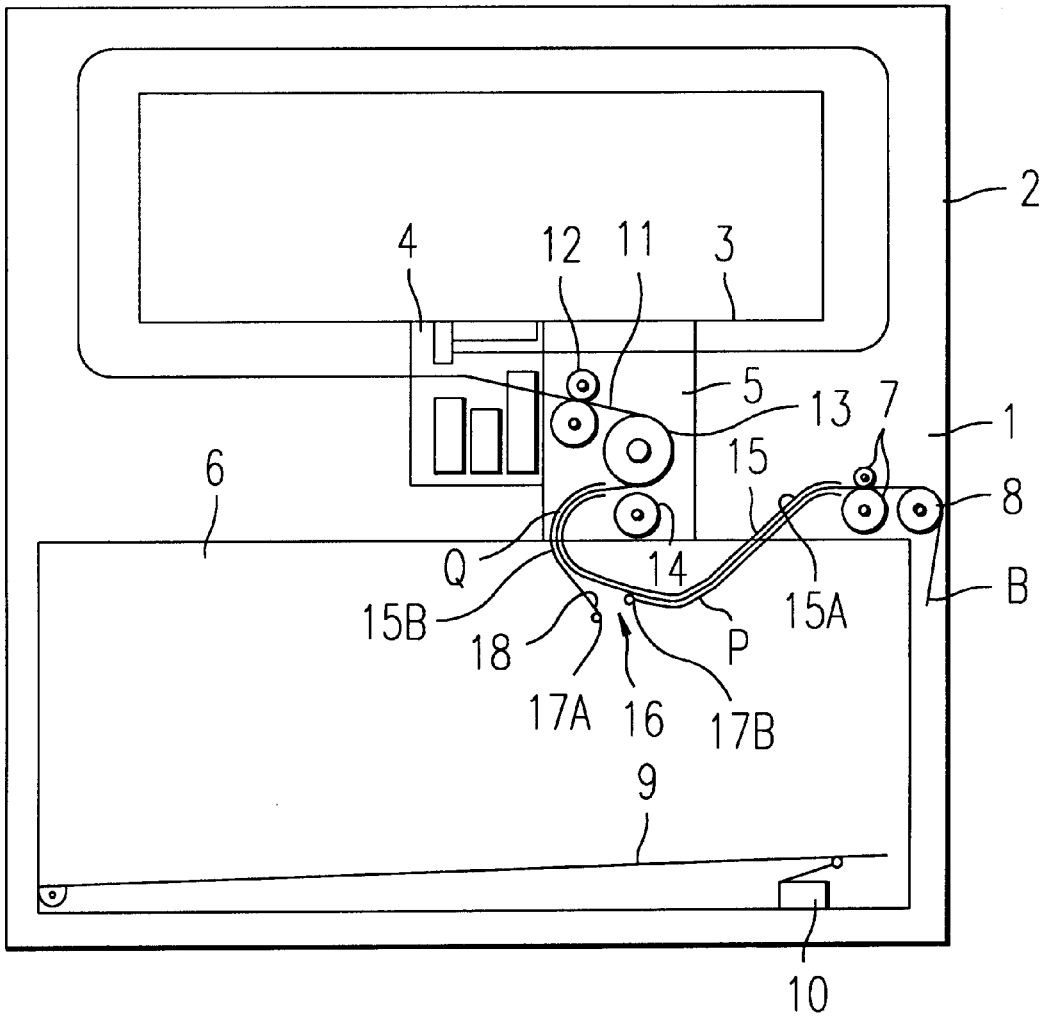
FIG. 2 is a sectional elevation showing a packing machine of the first embodiment of the present invention.
Figure 3:
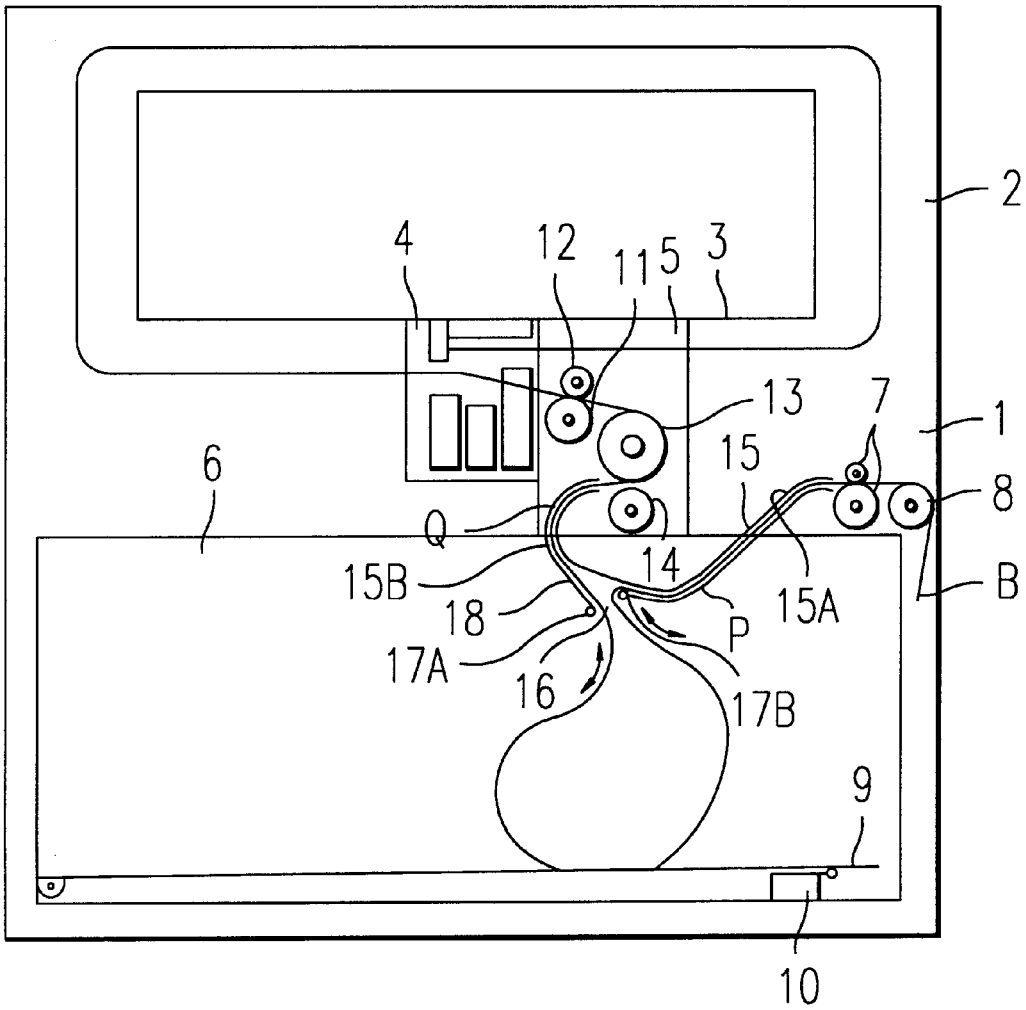
FIG. 3 is a sectional elevation showing the packing machine of FIG. 2 in use.

FIG. 2 shows an inside of a pool box of a packing machine without a band reel (not shown). FIG. 2 also shows a typical structure of the packing machine.

1 is designated as the packing machine, 2 is designated as a band guide arch, 3 is designated as working table, 4 is designated as sealer unit, 5 is designated as a band forward-reverse unit, 6 is designated as a pool box, 7 is designated as a pair of pre-feed rollers which pull a band B into a band guide path 15 from the band reel, and 8 is designated as a guide roller. 9 is designated as a bottom plate rotatably mounted on the bottom of the pool box 6, and 10 is designated as a weight-detecting switch.

The band forward-reverse unit 5 feeds the band B to the band guide arch 2 via the sealer unit 4. The band forward-reverse unit 5 reverses the band B wound around a goods positioned in the band guide arch 2 into the pool box 6.

A feed roller 11 and a pressure roller 12 biased against the feed roller 11, also a reverse roller 13 and a pressure roller 14 biased against the reverse roller 13, contributes the band forward-reverse opearation.

Figure 4:
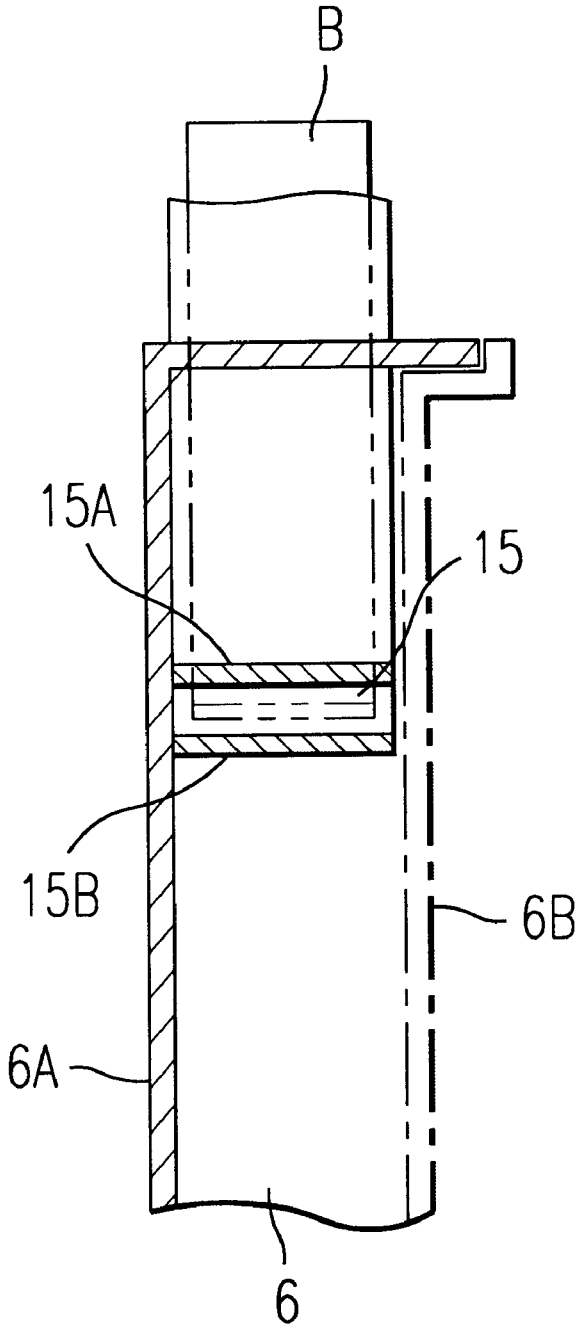
FIG. 4 is a sectional side elevation showing a pool box.

As shown in FIG. 4, the pool box 6 has a depth corresponding to a width of the band B. The pool box 6 is made of an open-front and flat-shaped casing 6*a* and a front plate 6*b* closing the front surface of the casing 6*a*.

15 is designated as a band guide path formed by a pair of parallel plates 15*a*, 15*b*. The parallel plates 15*a*, 15*b* are directly welded to an inside surface of the casing 6*a*. The band guide path 15 connects an exit of the pre-feed rollers 7 to the nip of the reverse roller 13 and the pressure roller 14, via the pool box 6. The side of the band guide path 15, positioned at an outside surface of the pool box 6, is shut so that band B cannot jump out. 16 is designated as an opening formed at a certain position in one of the parallel plates 15*b*. The opening is formed by cutting the parallel plate 15*b*, 17*a*, 17*b* are designated as edges of the opening 16. A guide slope 18 is formed at the opening 16. The guide slope 18 is formed by bending the parallel plate 15*b* downstream of the opening 16 so as to depart from the other parallel plate 15*a*.

P, Q are designated as gentle bends provided upstream and downstream of the opening 16.

In operation, the pre-feed rollers 7 are continuously driven. Thus, when an operator inserts the end of the band B into the nip of the pair of pre-feed rollers 7, the band B is fed in the band guide path 15. The band B goes through the bend P, the opening 16, the bend Q and the feed roller 11 of the band forward-reverse unit 5, and reaches the sealer unit 4 via the band guide arch 2. The end of the band B is sealed by the sealer unit 4. Then, the band B is set on the band guide arch 2. In accordance with switching operation by the operator, the feed roller 11 and the reverse roller 13 reverse. Accordingly, the band B is reversed by the feed roller 11 and the reverse roller 13, so that the goods positioned in the band guide arch 2 is banded tightly by the band B.

When the band B is inserted into the nip of the pair of pre-feed rollers 7 for the first time, the band B does not jump out from the opening 16 even if the end of the band B turns to the opening 16 due to previous winding of the band B. Because the end of the band B touches the guide slope 18, the end of the band B is guided into the band guide path 15. As mentioned above, the band B is continuously fed by the pre-feed rollers 7 although the sealer unit 4 seals the end of the band B. Thus, the band B will have no way to go. Consequently, as shown in FIG. 3, the band B will jump out from the opening 16 so that the band B will be stored in the pool box 6. When a certain amount of the band B has been stored in the pool box 6, the bottom plate 9 is pushed down by the stored band B, and the bottom plate 9 switches the weight-detecting switch 10 on. Then, the weight-detecting switch 10 outputs a signal to stop the motor (not shown) of the pre-feed rollers 7.

A second embodiment of the present invention is now explained with reference to FIGS. 5 and 6. The same parts as those in the first embodiment are designated by the same reference numerals, and are not again explained herein.

A V-shaped swing guide 20 can be used as the guide instead of the guide slope 18 of the first embodiment so that the band B may jump out of the opening 16 into the pool box 6. The V-shaped swing guide 20 includes one arm as a guide 23, another arm as an arm 26, and a connecting portion 21. The connecting portion 21 is rotatably mounted on an axis 22 provided adjacent to one edge 17*a* of the opening 16, so that the V-shaped swing guide 20 can be rotated. 24 is designated as a free end of the guide 23. The V-shaped swing guide 20 can be swung so as to increase and decrease the size of the opening 16.

27 is designated as a weight balancer fixed to an end of the arm 26.

Figure 5:
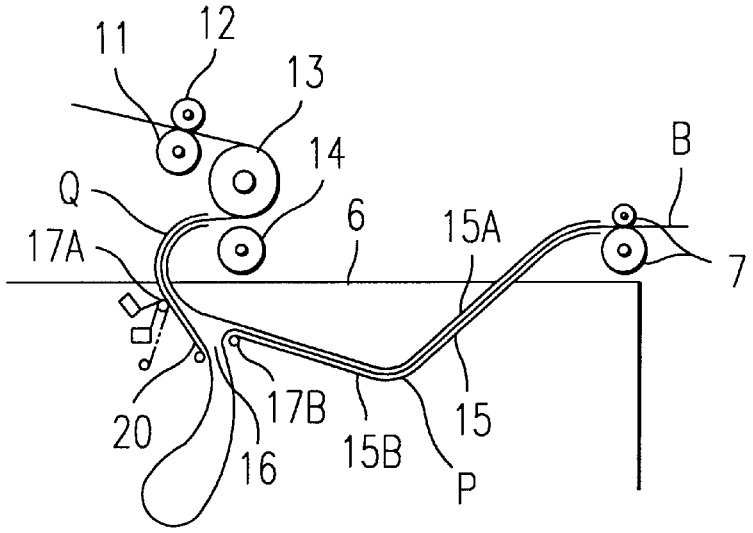
FIG. 5 is a sectional elevation showing a band guiding structure for a packing machine of the second embodiment of the present invention.
Figure 6:
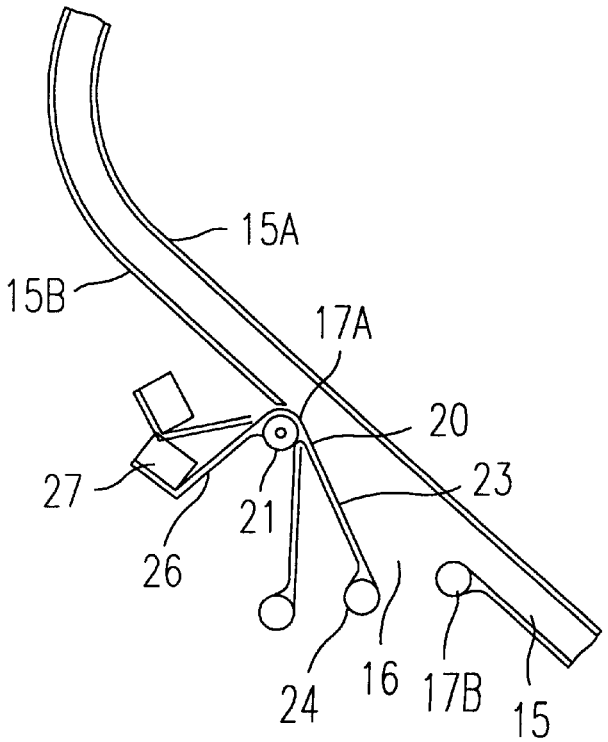
FIG. 6 is an enlarged vertical section showing the band guiding structure.

In operation, the V-shaped swing guide 20 normally balances at the position shown by the solid line in FIG. 5 and 6. The guide 23 of the V-shaped swing guide 20 operates as the guide slope 18 of the first embodiment when the end of the band B passes the opening 16. On the other hand, when the band B reverses after sealing by the sealer unit 4, the band B is bent at the opening 16 since the band B cannot go anywhere in the band guide path 15. Then, the guide 23 of the V-shaped swing guide 20 is moved by stiffness of the band B so that the V-shaped swing guide 20 rotates. Thus, the guide 23 of the V-shaped swing guide 20 lowers the resistance against the band B, so that the band B smoothly jumps out of the opening 16 into the pool box 6.

The band B also rotates the V-shaped swing guide 20 when the feed rollers 11, 12 pull the band B into the band guide path 15 for the next packing operation after a previous packing operation. Thus, the band B also smoothly jumps out from the opening 16 into the pool box 6 in this case.

The bend P, Q is useful for determining the position of the pre-feed rollers 7. Thus, it is preferable to provide the bend P, Q on the band guide path 15.

Further, the pre-feed rollers 7 are disposed upon the pool box 6, so that the band B can be easily inserted into the nip of the pre-feed rollers 7 by the operator.

A third embodiment of the present invention is now explained with reference to FIGS. 7 to 11. The same parts as those in the first embodiment are designated by the same reference numerals, and are not again explained herein.

First and second rotating guides 30*a*, 30*b* can be used as the guide, instead of the guide 16 slope 18 of the first embodiment of the present invention, so that the band B may jump out of the openings 16*a*, 16*b* into the pool box 6.

Figure 8:
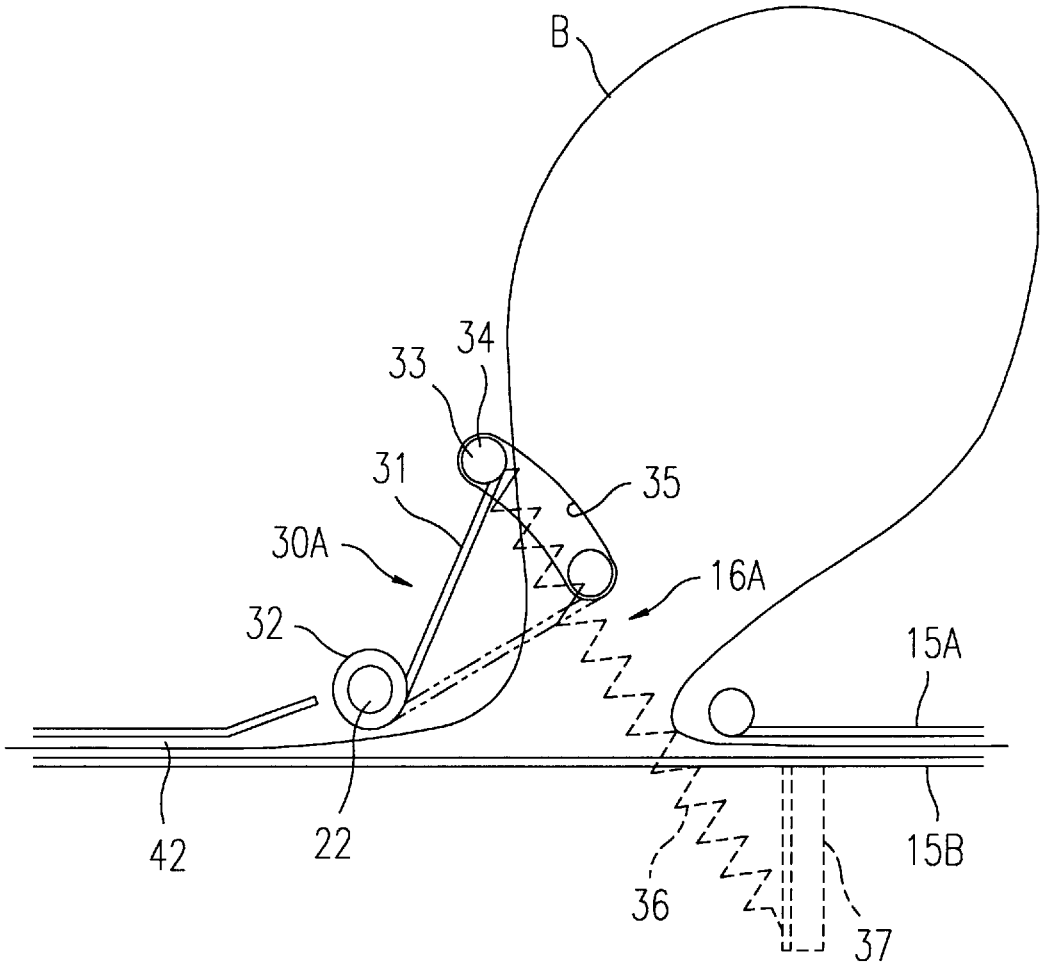
FIG. 8 is an enlarged elevation showing a first band guiding structure.
Figure 9:
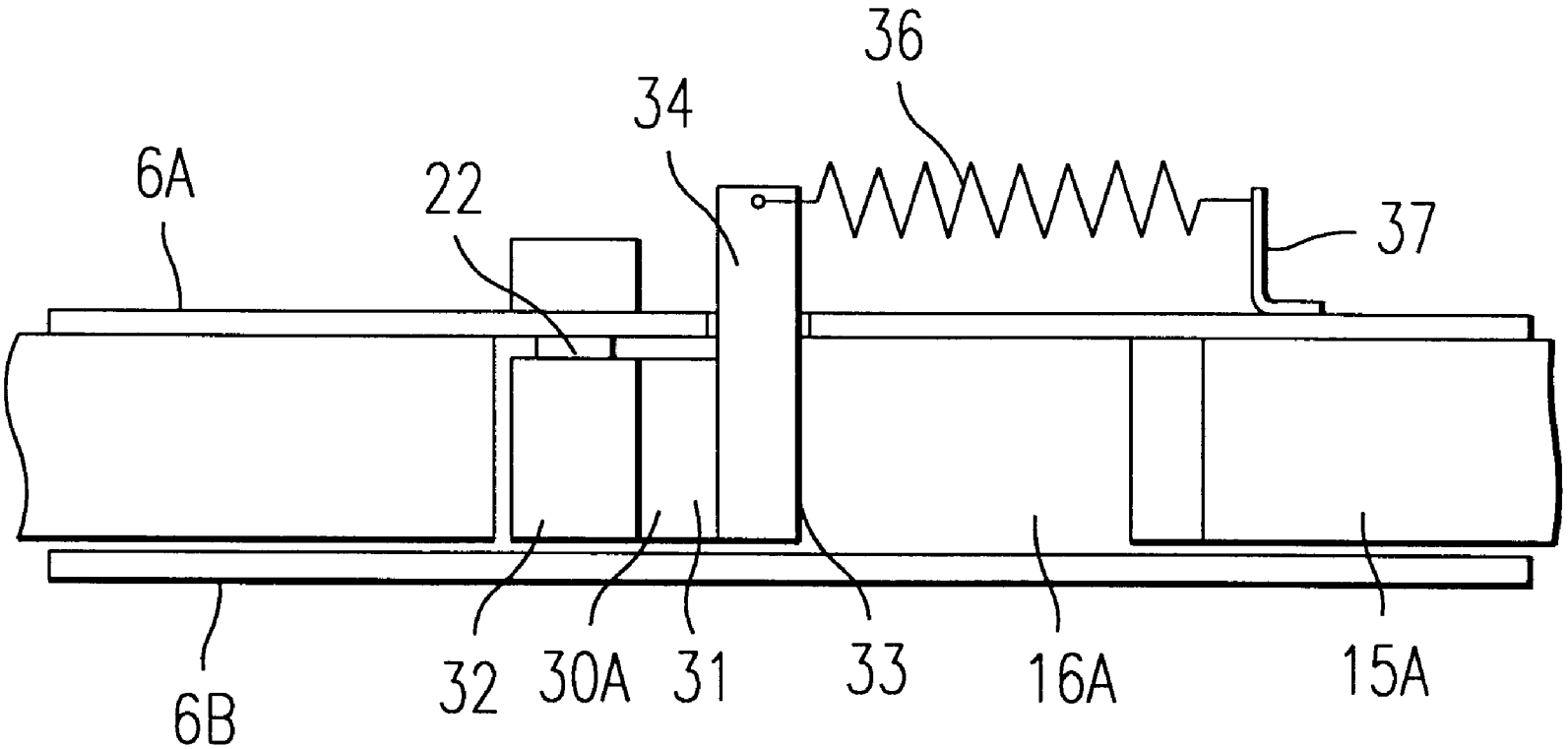
FIG. 9 is a plan view showing the first band guiding structure.

As shown in FIGS. 8 and 9, the first rotating guide 30*a* includes a guide 31 having a boss 32 at one end and a pin 34 at the other end. The boss 32 is rotatably attached to one edge of a first opening 16*a* by the axis 22. The pin 34 penetrates the casing 6*a*. 35 is 21 designated as an arc-shaped groove for limiting the swinging area of the pin 34. 36 is designated as a coil spring, 37 is designated as an anchor provided at a reverse side of the casing 6*a*. The pin 36 and the anchor 37 are connected with a spring 36. Thus, the spring 36 operates to urge the first rotating guide 30*a* so as to decrease the opening space of the first opening 16*a*. In one embodiment, the boss 32 and the axis 22 can be connected by a coil 26 spring (not shown) wound around the axis 22, instead of using the spring 36.

Figure 10:
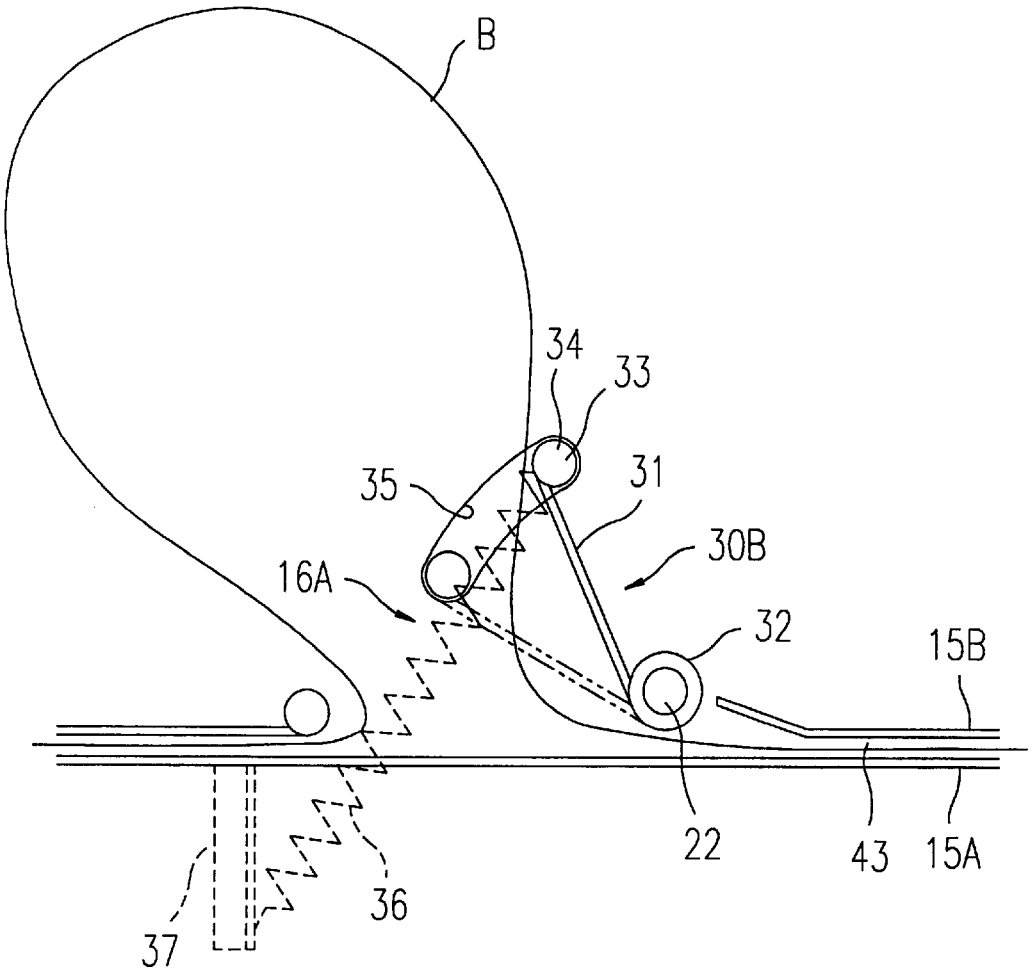
FIG. 10 is an enlarged elevation showing a second band guiding structure.
Figure 11:
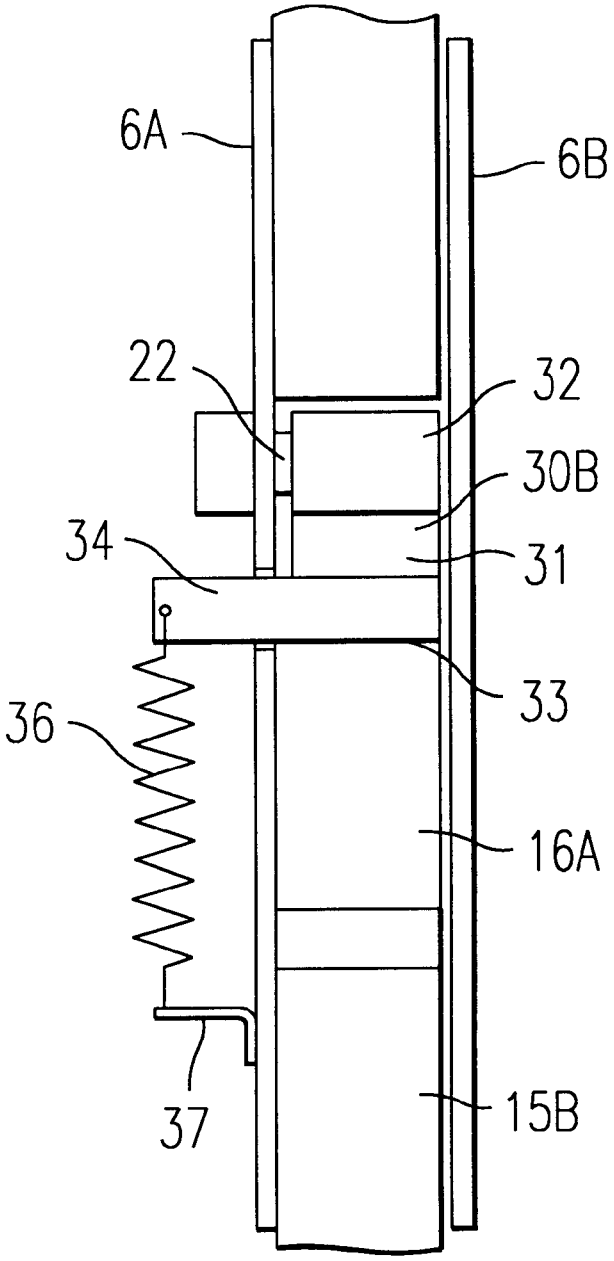
FIG. 11 is a plan view showing the second band guiding structure.

As shown in FIGS. 10 and 11, the second rotating guide 30b includes a guide 31 having a boss 32 at one end and a pin 34 at the other end. The boss 32 is rotatably attached to one edge of a second opening 16*b* by the axis 22. The pin 34 penetrates the casing 6*a*. 35 is designated as an arc-shaped groove for limiting the swinging area of the pin 34. 36 is 31 designated as a coil spring. 37 is designated as an anchor provided at a reverse side of the casing 6*a*. The pin 36 and the anchor 37 are connected with a spring 36. Thus, the spring 36 operates to urge the second rotating guide 30*b* so as to decrease the opening space of the second opening 16*b*. In one embodiment, the boss 32 and the axis 22 can be connected by a coil spring (not shown) wound around the axis 22, instead of the spring 36.

In the third embodiment of the present invention, the direction of rotating guides 30*a*, 30*b* is not limited since the guides 31 urged by the springs 36 do not rotate by gravity.

Figure 7:
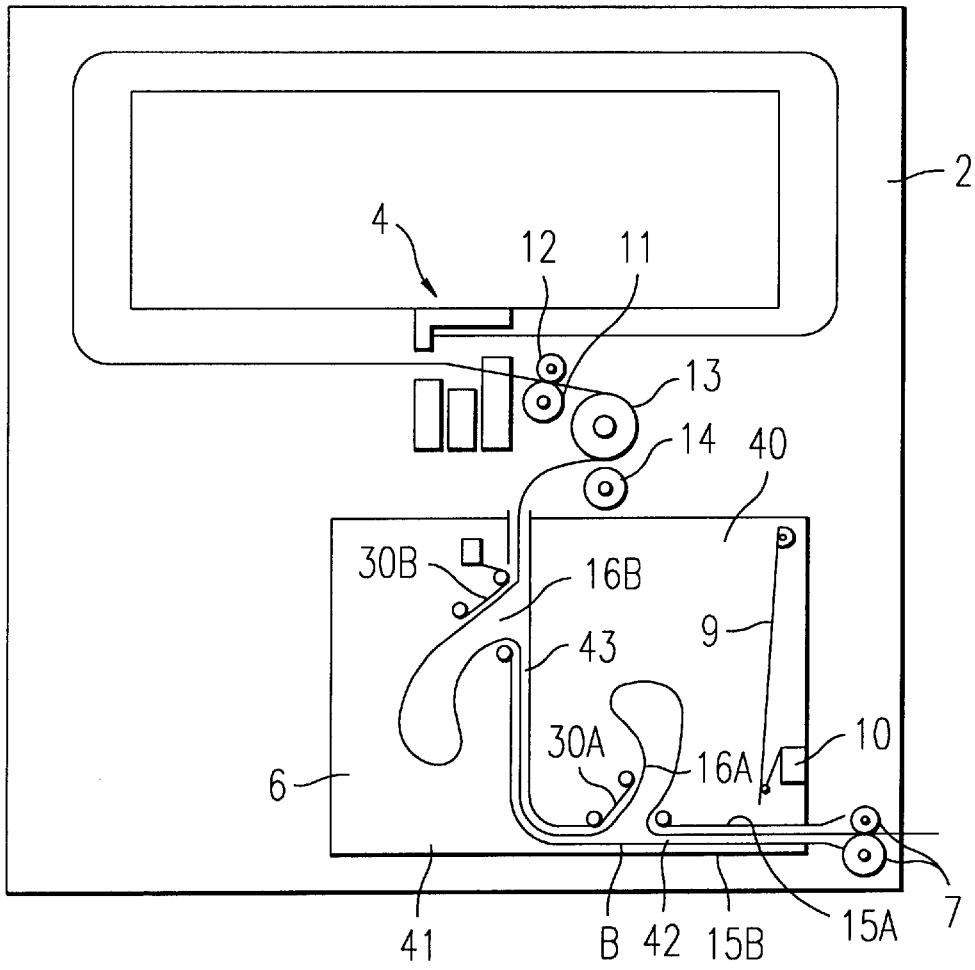
FIG. 7 is a sectional elevation showing a band guiding structure for a packing machine of the third embodiment of the present invention.

As shown in FIG. 7, the inside of the pool box 6 is separated by the band guide unit 15 into a feed band chamber 40 and a reverse band chamber 41. The pre-feed rollers 7 are disposed at a lower part of a frame. The band guide path 15 includes a horizontal guide path 42 and a vertical guide path 43 which is connected with the horizontal guide path 42, in the pool box 6. The first opening 16*a* is formed on one of the parallel plates 15*a* facing the feed band chamber 40. The second opening 16b is formed on one of the parallel plates 15*b* facing the reverse band chamber 41. In one embodiment, the first rotating guide 30*a* is provided at an edge of the first opening 16*a* of the horizontal band guide 42, and the second rotating guide 30*b* is provided at one end of the second opening 16*b* of the vertical band guide 43.

The horizontal band guide path 42 and the vertical band guide path 43 are not strictly limited to a horizontal arrangement and vertical arrangement. That is, the horizontal band guide path 42 and the vertical guide path 43 can be inclined to a horizontal line and a vertical line respectively. Further, the first and second rotating guides 30*a*, 30*b* can be merely provided on the vertical guide path 43 with the first rotating guide 30*a* facing the feed band chamber 40, and the second rotating guide facing the reverse band chamber 41. In this embodiment, the V-shaped swing guide 20 of the second embodiment can be used, instead of the first and second rotating guides 30*a*, 30*b*.

In operation, as mentioned above, the pre-feed rollers 7 are continuously driven although the band B has been set to the sealer unit 4. Thus, the band B fed by the pre-feed rollers 7 pushes up the first rotating guide 30*a* against an urging power of the spring 36, so that the opening space of the opening 16*a* will be increased. Then, the fed band B will jump out of the opening 16*a* into the feed band chamber 40. As mentioned above, the band B reverses by the reverse roller 13 for banding the goods tight. Thus, the band B reversed by the reverse roller 13 pushes up the second rotating guide 30*b* against the urging power of the spring 36, so that the opening space of the opening 16*b* will be increased. Then, the reversed band B will jump out of the opening 16*b* into the reverse band chamber 41.

Accordingly, the fed band B is stored in the feed band chamber 40 and reversed band B is stored in the reverse band chamber 41 individually. Thus, the band B stored in the feed band chamber 40 and the reverse band chamber 41 never touch, so that the band B is smoothly stored in the pool box 6.

In the first to third embodiments of the invention, a length of the guide 23 and the guides 31 are approximately 3 to 5 cm. Thus, the guide 23 and the guides 31 are very small in proportion to the capacity of the pool box 6.

As described above, the band guiding structure of the present invention is capable of guiding a band B to the pool box 6 without moving a band guide path 15. Accordingly, the band B can be smoothly fed through the band guide path 15. No more than two attempts for a balance adjustment of the V-shaped swing guide 20 in the second embodiment is necessary.

Also, no more than two attempts for a spring adjustment of the rotating guides 30*a*, 30*b* of the third embodiment of the present invention is necessary. Furthermore, abrasion and trouble do not usually occur with respect to the V-shaped swing guide 20 in the second embodiment and the rotating guides 30*a*, 30*b* of the third embodiment of the present invention. Thus, the maintenance of the band guiding structure is very simple.

The band guiding structure of the present invention is also capable of guiding a band B to the pool box 6 without a power source. Thus, parts and maintenance costs are low. Further, the opening space of the opening 16 can be changed corresponding to the bent shape of the band B, so that the band B can smoothly pass the opening 16. Thus, a band B having low stiffness can be used.

The present invention my be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Document 10-75011 filed on Mar. 10, 1998, the content of which are incorporated herein by reference.

What is claimed is:

1. A band guiding structure for a packing machine, comprising:

a band guide path formed by two parallel plates and placed in a pool box arranged between a pre-feed roller and a band forward-reverse unit, said band guide path connecting said pre-feed roller to said band forward-reverse unit;

an opening formed by a cutting of one of said parallel plates, said opening being disposed in said pool box; and means for guiding an end of said band so as not to jump out from said opening;

said means being a guide slope extending from a portion of said cutting located downstream of said band guide path so as to expand said opening, said guide slope extending into said pool box at an angle for guiding the end of a forward fed band into said band guide path and a back fed band into said pool box.

2. A band guiding structure for a packing machine, comprising:

a band guide path formed by two parallel plates and placed in a pool box arranged between a pre-feed roller and a band forward-reverse unit, said band guide path connecting said pre-feed roller to said band forward-reverse unit;

an opening formed by cutting one of said parallel plates, said opening being disposed in said pool box; and means for guiding an end of said band so as not to jump out from said opening, said means comprising a guide which is swingable around an axis disposed adjacent an edge of said cutting located downstream of said band guide path so as to increase and decrease an opening space of said opening, said guide decreasing the opening space of said opening in balance, wherein, said guide guides an end of said forward fed band into said band guide path in the balanced position, and said guide is urged by a back fed band so that said guide swings so as to increase the opening space and to guide said back fed band into said pool box.

3. A band guiding structure for a packing machine, comprising:

a band guide path formed by two parallel plates and placed in a pool box arranged between a pre-feed roller and a band forward-reverse unit, said band guide path connecting said pre-feed roller to said band forward-reverse unit;

an opening formed by cutting one of said parallel plates, said opening being disposed in said pool box;

means for guiding an end of said band so as not to jump out from said opening, said means comprising a guide which is swingable around an axis disposed adjacent an edge of said cutting located downstream of said band guide path so as to increase and decrease an opening space of said opening; and means for urging said guide so as to decrease the opening space of said opening, wherein, said guide guides an end of said forward fed band into said band guide path, and said guide is urged by a back fed band so that said guide swings against said means for urging said guide so as to increase the opening space and to guide said back fed band into said pool box.

4. A band guiding structure for a packing machine according to claim 2, wherein said guide is rotatably mounted at an edge of said opening.

5. A band guiding structure for a packing machine according to claim 2, wherein said guide is formed in V-shape having one rotatably attached arm being a guide portion for increasing and decreasing the opening space of said opening, another arm being an arm for balancing said guide, and a connecting portion which is rotatably attached.

6. A band guiding structure for a packing machine according to claim 5, wherein said another arm has a balancer.

7. A band guiding structure for a packing machine according to claim 3, wherein said means for urging said guide is a spring.

8. A band guiding structure for a packing machine according to claim 3, wherein said guide is rotatably mounted at an edge of said opening.

9. A band guiding structure for a packing machine, comprising:

a band guide path formed by two parallel plates and placed in a pool box arranged between a pre-feed roller and a band forward-reverse unit, said band guide path connecting said pre-feed roller to said band forward-reverse unit, said band guide path in said pool box having a horizontal guide path connected to said pre-feed roller and a vertical guide path connecting said horizontal guide path to said band forward-reverse unit, said band guide path separating said pool box into a feed band chamber and a reverse band chamber;

a first opening formed by a first cutting of one of said parallel plates, and provided in said horizontal guide path so as to connect said feed band chamber;

means for guiding an end of said band so as not to jump out from said first opening, said means comprising a first guide which is swingable around an axis disposed adjacent an edge of said first cutting located downstream of said band guide path, so as to increase and decrease an opening space of said first opening;

means for urging said first guide so as to decrease the opening space of said first opening;

wherein said first guide guides the end of a forward-fed band into said band guide path and said first guide is urged by said forward-fed band so that said first guide swings against said means for urging so as to increase the first opening space and to guide said forward-fed band into said feed band chamber;

a second opening formed by a second cutting of one of said parallel plates, and provided in said vertical guide path so as to connect said reverse band chamber;

means for guiding an end of said band so as not to jump out from said second opening, said means comprising a second guide which is swingable around an axis disposed adjacent an edge of said second cutting located downstream of said band guide path so as to increase and decrease an opening space of said opening; and means for urging said second guide so as to decrease the opening space of said second opening;

wherein said second guide guides the end of said forward-fed band into said band guide path, and said guide is urged by said back-fed band so that said second guide swings against said means for urging so as to increase the second opening space and to guide said back-fed band back into said band chamber.

10. A band guiding structure for a packing machine according to claim 9, wherein said means for urging said first guide is a spring.

11. A band guiding structure for a packing machine according to claim 9, wherein said means for urging said second guide is a spring.

12. A band guiding structure for a packing machine according to claim 9, wherein said first guide is rotatably mounted at an edge of said first opening.

13. A band guiding structure for a packing machine according to claim 9, wherein said second guide is rotatably mounted at an edge of said second opening.

* * * * *